US005692653A

United States Patent [19]

Hangley

[11] Patent Number: 5,692,653

[45] Date of Patent: Dec. 2, 1997

[54] REMOVING AND STACKING APPARATUS

[75] Inventor: James Patrick Hangley, Long Beach, N.Y.

[73] Assignee: Dow Corning Corporation, Midland, Mich.

[21] Appl. No.: 717,666

[22] Filed: Sep. 23, 1996

Related U.S. Application Data

[62] Division of Ser. No. 522,810, Sep. 1, 1995.

[51] Int. Cl.[6] ..... D06C 15/00

[52] U.S. Cl. ..... 223/72; 223/1

[58] Field of Search ..... 901/6; 274/175; 414/225, 226; 223/1, 52, 37, 38, 72

[56] References Cited

U.S. PATENT DOCUMENTS

| | | | |
|---|---|---|---|
| 3,713,567 | 1/1973 | Paris | 223/73 |
| 4,144,825 | 3/1979 | Angele et al. | 271/175 |
| 4,463,944 | 8/1984 | Grantham | 275/175 |
| 4,607,589 | 8/1986 | Gibson | 118/201 |
| 4,624,615 | 11/1986 | Russell et al. | 271/175 |
| 4,763,600 | 8/1988 | Saunders et al. | 118/684 |
| 5,018,463 | 5/1991 | Nakajima | 271/175 |

*Primary Examiner*—Bibhu Mohanty
*Attorney, Agent, or Firm*—Robert L. McKellar

[57] ABSTRACT

This invention disclosed herein deals with an apparatus for removing and stacking trousers after they have been processed through a separate apparatus for crease permanency or pressing.

2 Claims, 5 Drawing Sheets

REMOVING AND STACKING APPARATUS

This is a divisional of copending application Ser. No. 08/522,810 filed on Sep. 1, 1995.

BACKGROUND OF THE INVENTION

This invention deals with an apparatus for removing and stacking trousers after they have been processed through a separate apparatus for crease permanency or pressing, or the like.

There exists in the industry a need for processing trousers with crease permanency and this need has encouraged those who service that industry to provide the means for such permanent creasing.

One such method and apparatus is disclosed in U.S. Pat. No. 4,607,589, issued Aug. 26, 1986 to Gibson, in which an apparatus for the application of crease setting compositions to trousers involves a vertical arrangement which consists of a form, over which the trousers are placed, a means of withdrawing the trousers from the form, and a means for placing crease setting compositions in the crease as the trousers are removed.

The apparatus of that invention is usually employed together with a cooperating mechanism capable of lowering the trousers onto the apparatus of the invention and removing them after the crease setting agent has been applied. The apparatus of the patent may be provided in pairs so that both trouser legs can be treated simultaneously. The trousers are conveniently conveyed hanging down from a conveyor supported by the bottoms of the legs, and are then lowered on to and removed upwardly from the apparatus, before passing to a subsequent treating or packing station. Such a mechanism is suggested in that patent, but details of such an apparatus are not disclosed, except to state that it may be a conveyor so that a continuous stream of trousers can be treated.

In actual practice, the device from the '589 patent is in use today and operates such that an operator places trousers over two vertical sets of arms which expand pulling the creases taut at the cuffs. A pair of grippers are lowered on a chain which is controlled by an electric motor. The trousers are grasped at the cuffs and removed by pulling them up. When the trousers have been removed, the cuffs are approximately ten feet in the air. A second set of grippers are waiting for the trousers at the top of the machine. They are mounted on a rodless cylinder which after the second set of grippers are activated, and the first are released, the trousers are carried horizontally to a stacking station which is approximately eight feet in the air. This stacking station is also mounted on a rodless cylinder. When the stacking station is filled, it is lowered by the second rodless cylinder so that the operator can remove the trousers.

A second type of apparatus for permanently setting a pre-formed crease in a pair of trousers comprises that disclosed in U.S. Pat. No. 4,763,600, issued Aug. 16, 1988 to Saunders, et al.

This patent is incorporated herein by reference for what it teaches about such an apparatus and its use and as part of the combination of a system described and claimed herein for permanently creasing trousers and removal and stacking of such trousers.

The Saunders, et al patent describes an apparatus which can consist of a horizontal apparatus having a support member and lower and upper crease blades pivoted on the support member. The free ends of the crease blades extend away from the support member and include applicator nozzles that are directed upward for the upper crease blades and downward for the lower crease blades. When the apparatus has received a pair of pre-creased trousers over the crease blades and the lower crease blades are pivoted downward, the trousers are pulled taut at the hems between the pre-formed creases and as the trousers are pulled off of the crease blades, a pumping mechanism supplies a flowable, curable setting material such as silicone rubber to the applicator nozzles, which applies a coating of setting material to the inside surfaces of the trousers along the creases.

BRIEF DESCRIPTION OF THE DRAWINGS

FIG. 3 is a full view of the apparatii of FIG. 1 and FIG. 2 with regard to their combined working relationship.

THE INVENTION

Figure 1:
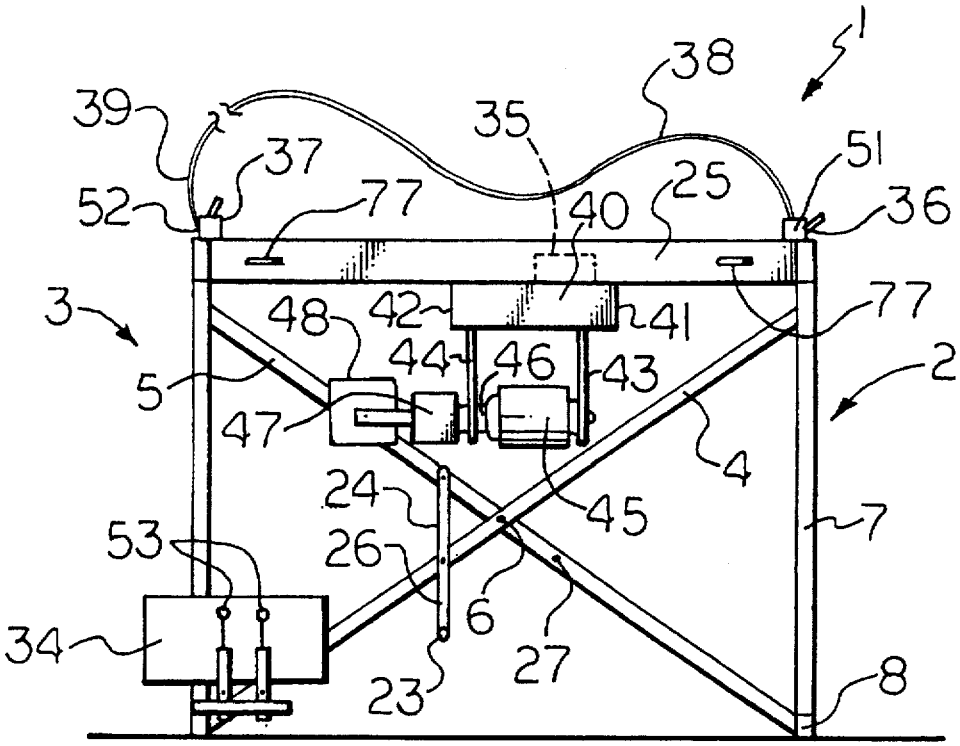
FIG. 1 is a full front view of an apparatus of this invention.

Thus, what is disclosed is a device for removing and stacking creased trousers from an apparatus used for applying a flowable, curable setting material to the inside crease surface of the trousers, or an apparatus for pressing the trousers. The device comprises a supporting frame comprised of two end segments, one such end segment being a near end segment, and the other end segment being a distal end segment.

Each end segment is comprised of a C-shaped frame having a vertical post, each said vertical post having a top and a bottom, a top arm, having a near end and a distal end, said top arm being attached to the vertical post at the near end thereof, and the top arm extending perpendicular to the vertical post and, a bottom arm, having a near end and a distal end, the bottom arm being attached to the vertical post at the near end thereof, and the bottom arm extending perpendicular to the vertical post and, a set of two cross braces to support the end segments, each of the braces attached near the top of one vertical post and near the bottom of the other vertical post and each cross brace having a midpoint wherein the braces cross each other.

There is a rodless cylinder, the rodless cylinder being located between, and detachedly fixed to the distal ends of the top arms, and having a reciprocatable block contained therein. There is a trolley, and the trolley has a near end and a distal end, said trolley being attached to the reciprocatable block and moving therewith, said trolley having vertical support hangers fixedly attached on the near end the distal end of the trolley.

There is also a rotary actuator located between the vertical support hangers and supported therein, the rotary actuator having a drive end wherein the drive end extends through the distal end vertical support hanger and attaches to a gripper support block. The gripper support block has mounted thereon, a set of two movable grippers, said support block having a resting position and a working position, said rotary actuator being capable of rotating the gripper support block at least 90° from the resting position to a working position and returning to the resting position. And finally, there is a stacking starter. The stacking starter is comprised of a stacking starter support, wherein the support is attached to the distal end of the bottom arm of the distal end segment. It also includes at least one driving apparatus and, a stacking starter plate, wherein the stacking starter plate is attached to the driving apparatus such that the stacking starter plate can be driven in an up and down motion.

There is also disclosed a system for providing permanently creased trousers. The system comprises in combination, the device just described above, and an apparatus for permanently setting pre-formed creases in a pair of trousers. The apparatus for permanently setting pre-formed creases in a pair of trousers comprises a stanchion member; a pair of spaced-apart substantially parallel support members each having one end fixed to said stanchion member and a free end extending substantially horizontally from said stanchion member, and, a pair of substantially horizontal first crease blades each aligned with and positioned above an individual one of said support members and fixed to said individual support member, each of said first crease blades having a free end extending away from said stanchion member, and said free end of each of said first crease blades including an upper applicator nozzle directed substantially upward; a pair of second crease blades each aligned with an individual one of said support members, each of said second crease blades having one end pivotally connected to said individual support member and a free end extending away from said stanchion member, and said free end of each of said second crease blades including a lower applicator nozzle directed substantially downward; a means for pivoting the free ends of said second crease blades away from said free ends of said first crease blades; and, a means for supplying a flowable, curable setting material to said upper and lower applicator nozzles.

There is further provided a method of removing and stacking trousers, the method comprising providing trousers to be removed and stacked; using the removing and stacking device described above to remove and stack the trousers.

There is also provided a method of permanently creasing trousers, the method comprises providing trousers which are pre-creased; aligning the trousers on an apparatus used for permanently creasing trousers such that the creases are essentially straight; applying a flowable, curable setting material to the pre-creases in the trousers; removing and stacking the trousers from the apparatus by utilizing the device of this invention; allowing the trousers to remain stacked until the flowable, curable setting material has cured, whereby the trousers are permanently creased.

Even still, there is disclosed a device for removing and stacking creased trousers from a trouser pressing apparatus, said device comprising the removing and stacking device disclosed and claimed herein in conjunction with a pressing apparatus comprising essentially of an apparatus as set forth and described in U.S. Pat. No. 3,713,567.

A system for providing pressed trousers, said system comprising in combination the removing and stacking device disclosed and claimed herein and an apparatus for pressing the trousers.

DETAILED DESCRIPTION OF THE INVENTION

Turning now to the detailed description of the various embodiments of the invention, and with reference to FIG. 1, there is shown an apparatus 1 of the instant invention which is a trousers removal and stacking device. The device 1 is comprised of a frame which has a near end 2 and a distal end 3, cross braces 4 and 5 which have a mutual cross point 6, along with a rodless cylinder 25 which will be disclosed in detail infra, as the supporting frame of the invention.

Figure 4:
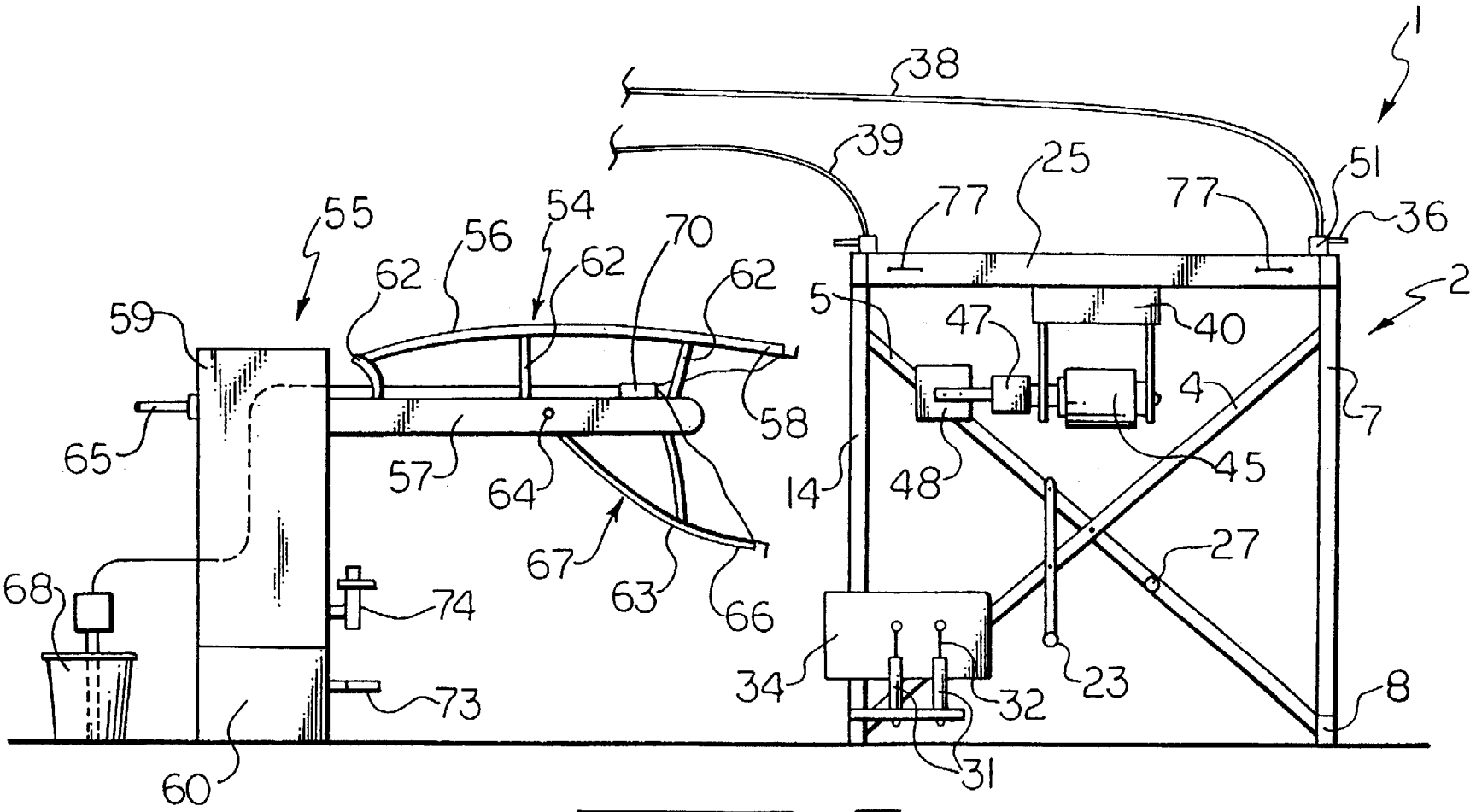
FIG. 4 is a near end view of the apparatus of FIG. 1.
Figure 4:
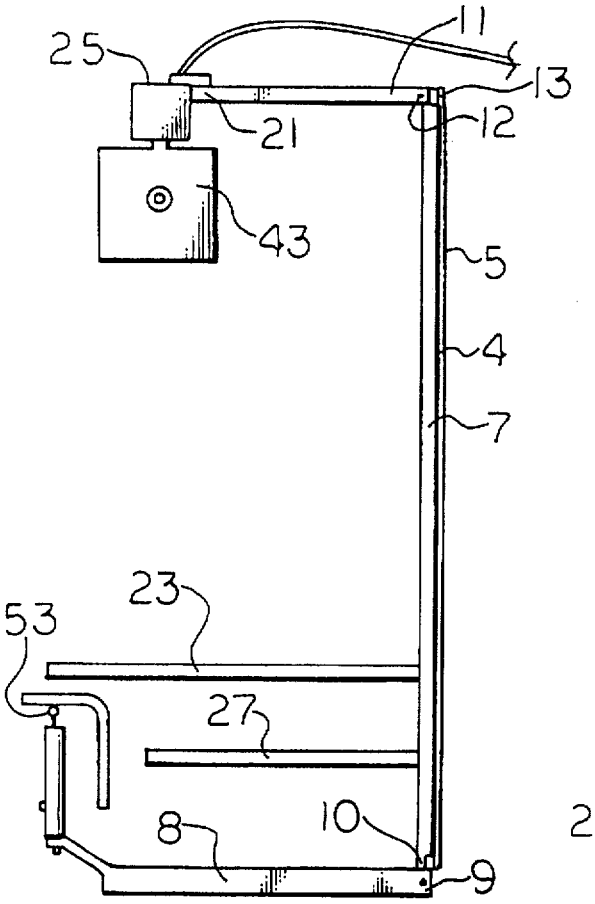

With reference to FIG. 4, it can be observed that the near end 2 of the frame has a C-shaped configuration, as does the distal end 3 of the frame. The C-shape comprises a vertical post 7, a horizontal lower arm 8 which is affixed by its near end 9 to the vertical post 7 at its lower end 10.

The C-shape near end 2 also has a horizontal upper arm 11, which is affixed by its near end 12 to the vertical post 7 at its upper end 13.

Likewise, the distal end 3 has a C-shaped configuration. The C-shape comprises a vertical post 14, a horizontal upper arm 15 which is affixed by its near end 16 to the vertical post 14 at its upper end 17 and a lower horizontal arm 18 which is affixed by its near end 19 to the vertical post 14 at its lower end 20.

Returning with reference to FIG. 1, there is shown a completion of the support frame by the inclusion of a rodless cylinder 25, which is affixed to and between the respective upper arms 11 and 15 at their distal ends 21 and 22, respectively, to essentially complete the frame of the apparatus.

The two ends 2 and 3 of the frame are stabilized by cross braces 4 an 5, and the cross brace 4, for purposes of illustration is affixed near the upper end of the vertical post 7 and at the back thereof. The opposite end of brace 4 is fastened to the lower end 20 of the vertical post 14 and on the back thereof. The other cross brace 5 is fastened near the upper end 13 of the vertical post 14 and the opposite end is fastened near the lower end 10 of vertical post 7, and the braces 4 and 5 cross and are fastened at point 6. The cross brace 4 and the cross brace 5 cooperate to the extent that a second brace, that is, a support 24 for a clothes rod 23 is affixed to the inside surfaces of the respective cross braces 4 and 5 in a vertical alignment. The clothes rod 23 is affixed to the lower end 26 of the clothes rod 23 such that it is perpendicular to the support 24, the purpose of such a clothes rod 23 being to hold, in cooperation with a second clothes rod 27, stacked trousers from the device 1, the essentials of which are described infra.

With regard to the distal end 3 of the frame, and specifically with respect to the lower arm 18 on vertical post 14, there is located a stacker support 28 which is fixed to the distal end 29 of the lower arm 18. Surmounting the stacker support 28 is a stacker support bar 30, which has activatable drive means 31 detachedly mounted thereon. Each of the drive means 31 have a drive end 32 which is detachedly attached to the back surface 33 of a trouser stacker 34. When the drive means 31 is activated, the drive means 31 moves in a reciprocal vertical motion, and carries with it the trouser stacker 34.

Slidably mounted in the interior of the rodless cylinder 25 is a reciprocatable block 35 (which is shown in phantom in FIG. 1) which moves in response to air pressured into the rodless cylinder 25 through ports 36 and 37. The movement of the rodless cylinder 25 is controlled by magnetic switches 77, or some similar means. Also shown are air pressure hoses 38 and 39 used for that purpose. Not shown in the air source, and neither the hoses or the air source form any part of this invention.

Mounted to the underside of the block 35 is a trolley 40, which trolley 40 moves simultaneously with the block 35 when the block 35 is activated.

The trolley 40 has mounted on its near end 41 and its distal end 42, vertical support hangers 43 and 44, respectively. There is a rotary actuator 45 located between the vertical support hangers 43 and 44. The rotary actuator 45 has a drive end 46 which extends through the distal end 42 vertical support hanger 44 and is attached to a gripper support block 47.

The gripper support block 47 has mounted on it at least one set of movable grippers 48, and in this illustration, there are shown two such grippers 48, which are separated and mounted towards the near outside end 49 and distal outside end 50 of the gripper support block 47.

With regard to FIG. 4, there is shown a near end view of the device 1 of this invention in which there is shown the vertical post 7, cross braces 4 and 5, upper arm 11, fastened to the vertical post 7 at the top 13 of the vertical post 7. At the distal end 21 of the upper arm 11 there is shown the rodless cylinder 25, the control value 51 for the rodless cylinder 25, the air hose 38, trolley 40, the vertical support hanger 43, the clothes rod 23, the second clothes rod 27, the lower arm 8, the lower arm 18, stacker support 28, stacker support bar 30, drive means 31, drive end 32, trouser stacker 34, and distal end 29 of lower arm 18.

Figure 5:
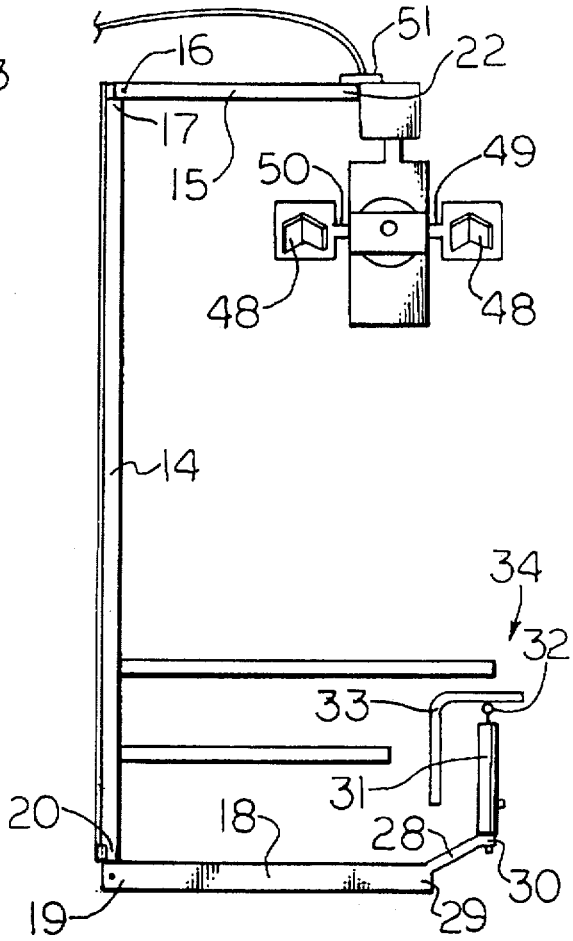
FIG. 5 is a distal end view of the apparatus of FIG. 1.

Viewing the device 1 of the instant invention from the opposite end, i.e. the distal end 3, and with reference to FIG. 5, there is shown the vertical post 14, the cross braces 4 and 5, the upper arm 15, attached to the upper end 17 of vertical post 14, the control valve 52 for the rodless cylinder 25, the air hose 39, the trolley 40, the vertical support hanger 44, the gripper support block 47, two sets of movable grippers 48, clothes rod 23, the second clothes rod 27, the lower 8, the lower arm 18, stacker support 28, the stacker support bar 30, drive means 31, drive end 32, trouser stacker 34, and distal end 29 of lower arm 18.

With further reference to FIG. 5, it should be noted that the gripper support block 47 is in the resting position, that is, the gripper support block 47 is horizontally positioned.

Figure 6:
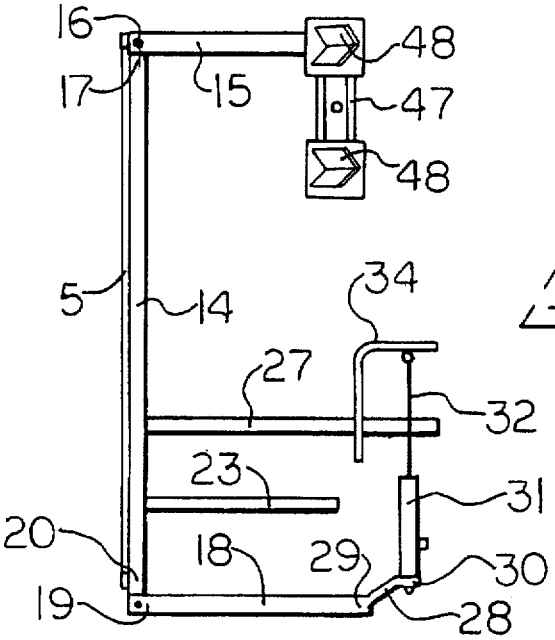
FIG. 6 is a distal end view of the apparatus of FIG. 1, in which the grippers are turned at a 90° angle from the resting position.

With reference to FIG. 6, there is shown essentially the view of FIG. 5, but the gripper support block 47 is turned an angle of 90° from the resting position, i.e. to the working position. It should be noted that the drive end 32 of the drive means 31 has been activated for purposes of illustration, and that the trouser stacker 34 is in an elevated position with regard to its normal resting position on the upper end 53 of the drive means 31.

The significance of the resting position and working position, and the position of the trouser stacker 34, will be clearer from the discussion of the operation of the device of this invention set forth infra.

Figure 2:
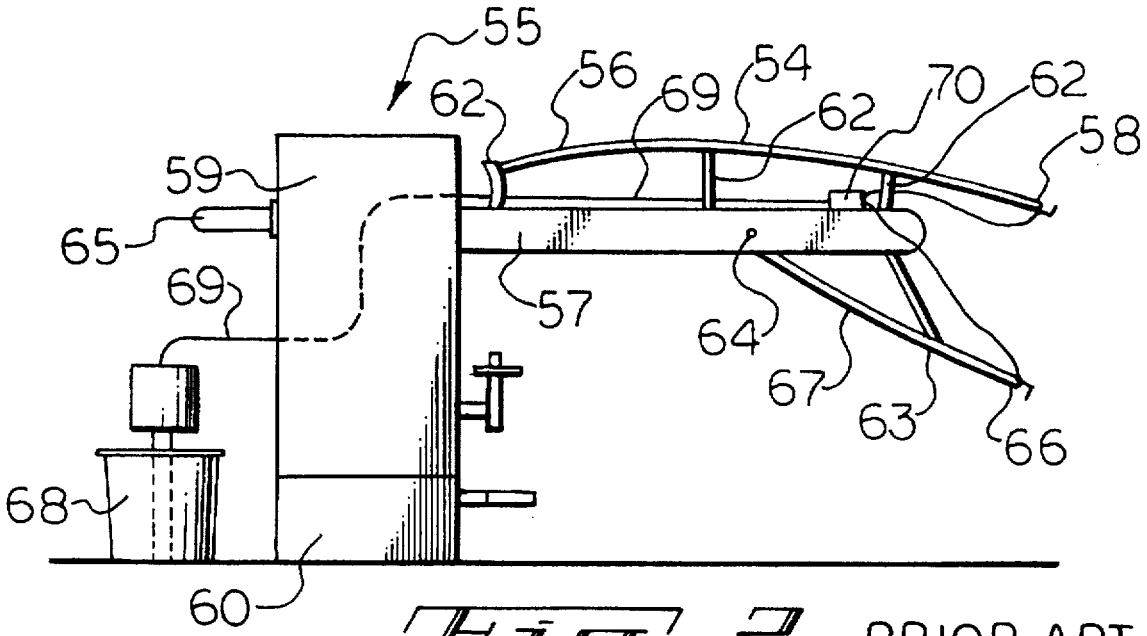
Fig. 2 PRIOR ART
FIG. 2 is a full side view of an apparatus used for placing the crease setting material in the crease of trousers.

Turning now to FIG. 2, there is shown a device 55 of U.S. Pat. No. 4,763,600, which is a device that is compatible with the device of this invention. The device 1 of this invention can be used in conjunction with the device of the '600 patent such that the instant invention device 1 will remove trousers from the '600 device and stack them.

Thus, the applicant has invented a combination of devices that include the device of the '600 patent and with regard to FIG. 2, there is shown the device 55 which includes a stanchion 59 extending vertically upward from a base portion 60 and a pair of spaced-apart substantially parallel support members 61 extending substantially horizontally from stanchion member 59.

The device 55 includes means for supporting each trouser leg of a pair of trousers along the inside surfaces of a pair of preformed creases in each trouser leg. As embodied in that device and herein, the supporting means includes pair of fixed substantially horizontal upper crease blade 56, each of which is aligned with and positioned above one of support members 57. Each upper crease blade 56 includes free end 58 extending away from stanchion member 59. Upper crease blades 56 are connected to their respective support members 61 by crease blade connectors 62. Preferably, upper crease blades 56 have a small radius top edge 54 to facilitate the alignment of the pre-formed creases of the trouser legs with the upper crease blades 56.

Device 55 includes means for pulling each trouser leg taut between the trouser leg's pair of creases. As embodied therein, the pulling means includes a pair of lower crease blades 63 each of which is pivotally connected to an individual support member 61 by pin 64. Free end 66 of each lower crease blade 63 extends in a direction away from stanchion member 59. The bottom edges 67 of crease blades 63 preferably are of a small radius.

Device 55 includes means for pivoting the free ends 66 of lower crease blades 63 away from free ends 57 of upper crease blades 56. As embodied in the '600 patent and herein, and as shown in FIG. 2, the pivoting means includes an air cylinder 65 mounted on the outside of stanchion 59.

Device 55 also includes means for applying a coating of a flowable, curable setting material along the inside surface of each crease of the trouser legs simultaneously as the trouser legs are slidably removed from the crease blades in a direction toward free ends 58 and 66. It should be noted that the trousers are generally removed by hand by an operator. The means for applying a coating herein is constituted by a supply source 68 for the flowable coating, a pump 69 to move the flowable coating, a transfer line 78 for the flowable coating, and a control 70 for applying the correct amount of the flowable coating to the crease in the trousers.

Figure 9:
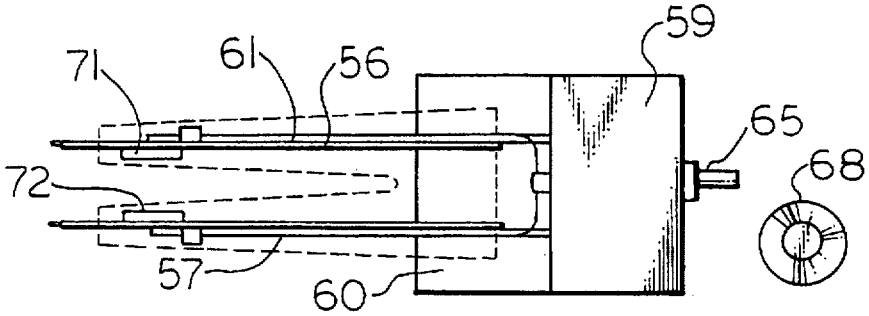
Fig. 9 PRIOR ART
FIG. 9 is a full top view of a device of U.S. Pat. No. 4,763,600.

Turning to FIG. 9, there is shown a full top view of the device 55 of U.S. Pat. No. 4,763,600 which device is fully incorporated herein by reference as part of the combination of devices set forth in the claims.

For orientation purposes, there is shown the upper crease blades 56, the stanchion 59, the flow control valve 70 for each of the transfer lines 69, the support means 57 for the crease blades 56, the 68, the air cylinder 65, and base 60. This Figure also includes a photoelectric cell 71, a receptor 72 for the photoelectric cell 71 whose function in combination with the device 1 of the invention will be described infra, an air flow control valve 73, and a solenoid valve 74.

Figure 7:
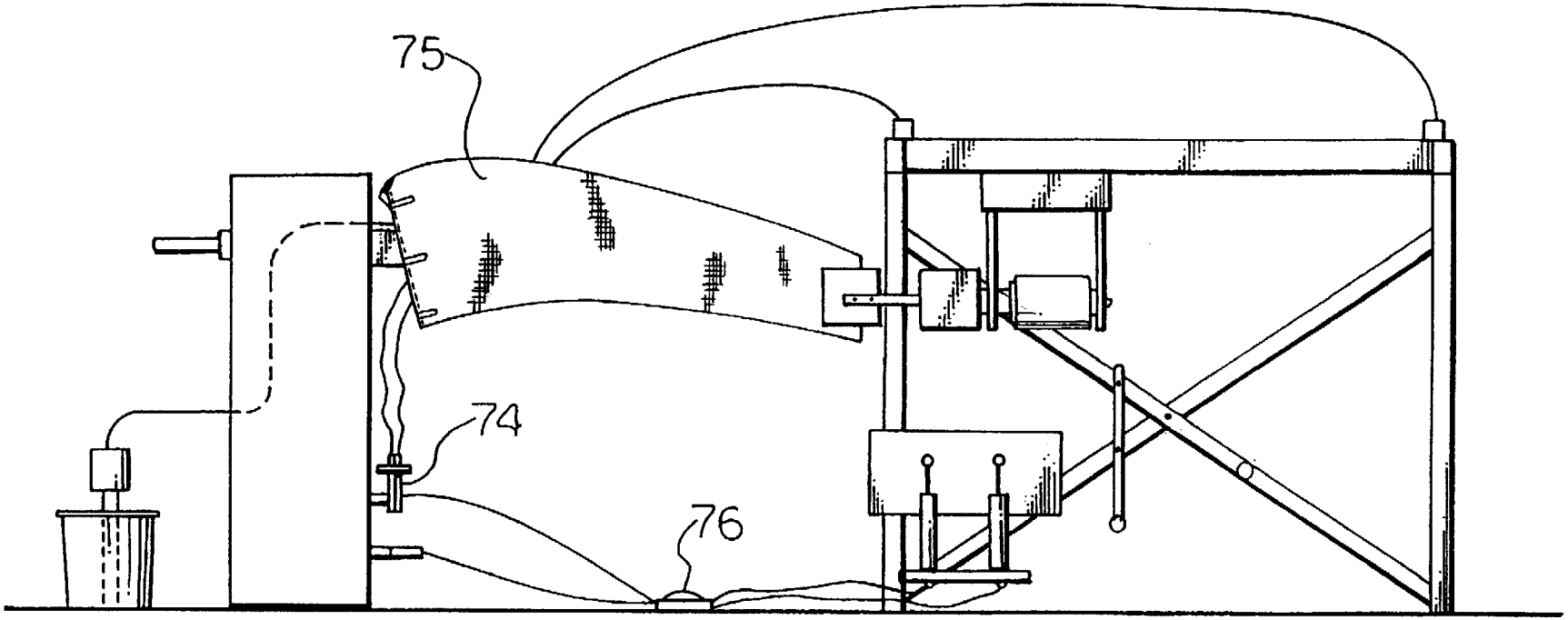
FIG. 7 is a full view of the combined apparatii of FIG. 3, showing the beginning of the removal of the trousers from the permanent crease setting apparatus.
Figure 8:
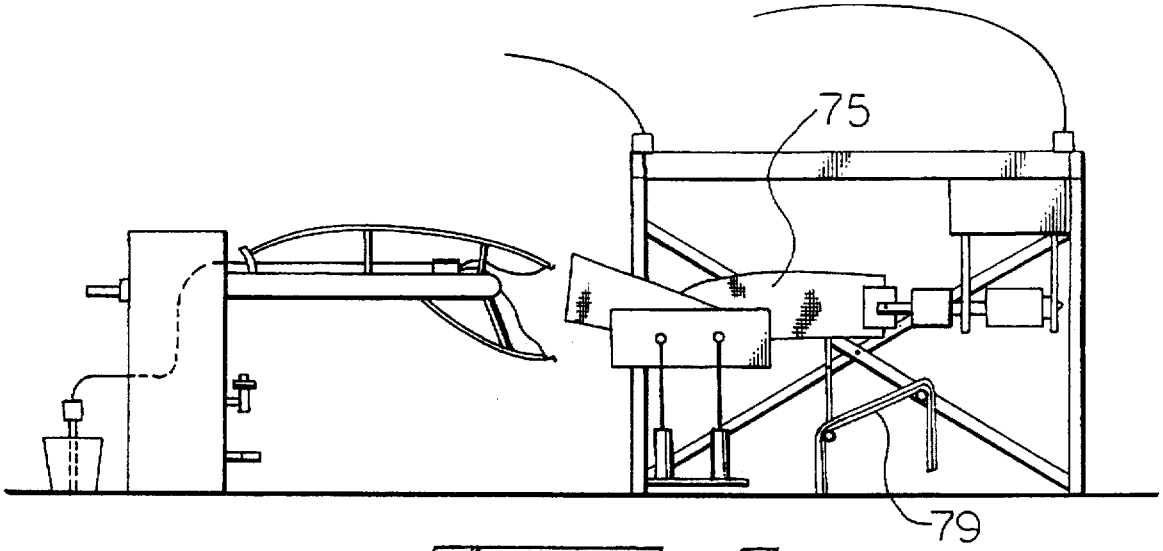
FIG. 8 is a full side view of the combined apparatii of FIG. 3, showing the upward stroke of the trouser stacker and the 90° turn of the grippers.

Turning now to the overall operation of the invention device of this invention and its use in combination with an apparatus for dispensing flowable material into creases of pre-formed trousers, and with reference to FIGS. 7 and 8, and firstly with FIG. 7, there is shown a device 1 of this invention, in combination and alignment with a device 55 of the '600 patent.

It should be understood by those skilled in the art that the activators for the entire system are coordinated to allow the two devices to accommodate each other and to work cooperatively with each other.

Thus, there is shown the device 1, the apparatus 55, the rodless cylinder 25, the rotary actuator 45, the movable grippers 48, a pair of trousers 75, which are aligned on the crease blades 56 and 63 by the pre-formed creases in the trousers 75. In this Figure, the trolley 40, along with the supports 43 and 44, and the rotary actuator 40, the gripper support block 47, and the movable grippers 48, all of which move simultaneously, are positioned at the distal end 3 of the frame of the device 1, although, the normal resting position for this movable assembly of the device 1 is at the near end 2, i.e. the right end in the FIG. 7, and with the grippers 48 in a vertical position.

There is shown an operator foot switch 76, which activates the entire system. The operator aligns the trousers 75 on the device 55, presses the foot switch 76 causing the air cylinder in device 55 to open, spreading the creases taut at the hems, while the actuator 45 is turning the grippers 90° and sending the moveable assembly described just above with regard to the grippers 48 to the distal end, i.e. the left end of the frame, and the grippers 48 grip the bottom edge of the trousers 75.

At this point in the overall operation, the pump 77 is activated, as are the controls for the rodless cylinder 25. The trousers 75 are drawn in essentially a straight line from the device 55, and as the trousers 75 are withdrawn at a controlled rate, the flowable material is deposited in all of the creases of the pre-creased trousers 75. When the trousers 75 have been removed from the device 55 to the extent that the crotch of the trousers 75 has passed the photoelectric cell 71, the legs of the trousers 75 no longer impede the transfer of a light beam from the photoelectric cell 71 to the receptor 72, and the photoelectric cell 71 transmits a light beam to the receptor 72 which automatically and simultaneously shuts down the flow of the flowable material to the creases, switches off the air cylinder in device 55 removing the tension in the trousers, activates the drive means 31 of the trouser stacker 34, which causes the trouser stacker 34 to be driven upwardly by the drive ends 32, which trouser stacker 34 contacts the uppers of the trousers 75, and flips the uppers of the trousers 75 inwardly towards the frame of the device 1, while at the same time, the rotary actuator 45 turns the gripper support block 47 inwardly towards the frame in a full 90° turn, which causes the grippers 48 to turn in the same direction, i.e. the "working" position, and turn the legs of the trousers 75 in an inwardly direction towards the frame. At or near the end of the rotation of the rotary actuator 45, the grippers 48 release the bottom edge of the trousers 75, and the above described entire operation causes the trousers 75 to be turned 90° and laid essentially flat, where they are released to drop by gravity to the clothes rod 23 and clothes rod 27. Processed trousers 79 are shown in FIG. 8, lying on the clothes rods.

It is also contemplated within the scope of this invention not to use the clothes rods 23 and 27, but to align a movable cart under the frame, in essentially the same position as the rods, and allow the trousers 75 to drop directly on the cart.

Upon the release of the trousers 75, the trouser stacker 34 returns to its resting position on the surface of the drive means 31, and the movable assembly containing the grippers 48 etcetera, automatically move back along the rodless cylinder 25 to the near end of the frame to be ready for the next cycle.

FIG. 8 represents the combination of equipment as shown in FIG. 7, but it should be noted that the trolley 40 has moved to the near end 2 of the frame and that the trousers 75 have been removed from the device 55, and that the trouser stacker 34 is at its highest point and has flipped the upper half of the trousers 75 inwardly towards the frame to start the stacking mode of the device 1.

It should be noted by those skilled in the art that there are various switches, activators, wires, hoses, cords, and the like that are used to electrically, pneumatically, and mechanically connect the devices 1 and 55 together, which are not shown in the drawings in order to help clarify the specification.

What is claimed is:

1. A method of removing and stacking trousers, the method comprising:

providing trousers to be removed and stacked;

using a device to remove and stack said trousers, the device comprising:

A. a supporting frame comprised of:

(a) two end segments, one such end segment being a near end segment, and the other end segment being a distal end segment, each end segment comprised of a C-shaped frame having (i) a vertical post, each said vertical post having a top and a bottom;

(ii) a top arm, having a near end and a distal end said top arm being attached to the vertical post a the near end thereof, and said top arm extending perpendicular to said vertical post and, (iii) a bottom arm, having a near end and a distal end, said bottom arm being attached to the vertical post at the near end thereof, and said bottom arm extending perpendicular to said vertical post and, (b) a set of two cross braces to support the end segments, each said brace attached near the top of one vertical post and near the bottom of the other vertical post and each cross brace having a midpoint wherein the braces cross each other;

(c) a rodless cylinder, said rodless cylinder being located between, and detachedly fixed to the distal ends of the top arms, and having:

(i) a reciprocatable block contained therein, (ii) a trolley, said trolley having a near end and a distal end, said trolley being attached to the reciprocatable block and moving therewith, said trolley having vertical support hangers fixedly attached on the near end and the distal end of the trolley;

B. a rotary actuator located between the vertical support hangers and being supported therein, said rotary actuator having a drive end; said drive end extending through the distal end vertical support hanger and attaching to a gripper support block, said gripper support block having mounted thereon, a set of two movable grippers, said support block having a resting position and a working position, said rotary actuator being capable of rotating the gripper support block at least 90° from the resting position to a working position and returning to the resting position, and C. a stacking starter, said stacking starter comprised of:

(i) a stacking starter support, said support being attached to the distal end of the bottom arm of the distal end segment;

(ii) at least one driving apparatus;

(iii) a stacking starter plate, wherein said plate is attached to the driving apparatus such that the stacking starter plate can be driven in an up and down motion.

2. A method of permanently creasing trousers, the method comprising:

I. providing trousers which are pre-creased;

II. aligning the trousers on an apparatus used for permanently creasing trousers such that the creases are essentially straight;

III. applying a flowable, curable setting material to the pre-creases in the trousers;

IV. removing and stacking the trousers from the apparatus by utilizing a device comprising:

A. A supporting frame comprised of:

(a) two end segments, one such end segment being a near end segment, and the other end segment being a distal end segment, each end segment comprised of a C-shaped frame having (i) a vertical post, each said vertical post having a top and a bottom;

(ii) a top arm, having a near end and a distal end said top arm being attached to the vertical post at the near end thereof, and said top arm extending perpendicular to said vertical post and, (iii) a bottom arm, having a near end and a distal end, said bottom arm being attached to the vertical post at the near end thereof, and said bottom arm extending perpendicular to said vertical post and, (b) a set of two cross braces to support the end segments, each said brace attached near the top of one vertical post and near the bottom of the other vertical post and each cross brace having a midpoint wherein the braces cross each other;

(c) a rodless cylinder, said rodless cylinder being located between, and detachedly fixed to the distal ends of the top arms, and having:

(i) a reciprocatable block contained therein, (ii) a trolley, said trolley having a near end and a distal end, said trolley being attached to the reciprocatable block and moving therewith, said trolley having vertical support hangers fixedly attached on the near end and the distal end of the trolley;

B. a rotary actuator located between the vertical support hangers and being supported therein, said rotary actuator having a drive end; said drive end extending through the distal end vertical support hanger and attaching to a gripper support block, said gripper support block having mounted thereon, a set of two movable grippers, said support block having a resting position and a working position, said rotary actuator being capable of rotating the gripper support block at least 90° from the resting position to a working position and returning to the resting position, and C. a stacking starter, said stacking starter comprised of:

(i) a stacking starter support, said support being attached to the distal end of the bottom arm of the distal end segment;

(ii) at least one driving apparatus;

(iii) a stacking starter plate, wherein said plate is attached to the driving apparatus such that the stacking starter plate can be driven in an up and down motion;

V. allowing the trousers to remain stacked until the flowable, curable setting material has cured, whereby the trousers are permanently creased.

* * * * *